US007630866B2

(12) United States Patent
Guesnon et al.

(10) Patent No.: US 7,630,866 B2
(45) Date of Patent: Dec. 8, 2009

(54) METHOD OF DIMENSIONING A DRILLING RISER

(75) Inventors: Jean Guesnon, Chatou (FR); Christian Gaillard, Rueil Malmaison (FR)

(73) Assignee: Institut Francais du Petrole, Rueil Malmaison Cedex (FR)

( * ) Notice: Subject to any disclaimer, the term of this patent is extended or adjusted under 35 U.S.C. 154(b) by 1666 days.

(21) Appl. No.: 10/153,768

(22) Filed: May 24, 2002

(65) Prior Publication Data

US 2003/0026663 A1 Feb. 6, 2003

(30) Foreign Application Priority Data

Mar. 25, 2001 (FR) ..... 01 07007

(51) Int. Cl.
*G06F 17/50* (2006.01)

(52) U.S. Cl. ..... 703/1; 703/10

(58) Field of Classification Search ..... 703/1; 405/224.2

See application file for complete search history.

(56) References Cited

U.S. PATENT DOCUMENTS 5,330,294 A * 7/1994 Guesnon ..... 405/224.2

FOREIGN PATENT DOCUMENTS

GB 2342938 4/2000

OTHER PUBLICATIONS

"The Dorada Field Production Risers", Wybro et al XP-002188781, Dec. 1982.

"Dynamic Analysis of Risers and Caissons By The Element Method", Gardner, et al, May 1976.

"Up-To-Date Spread Sheet Program For Preliminary Analysis of Flexible And Steel Catenary Risers Using Catenary Concepts", Femandes, Sep. 1997.

* cited by examiner

*Primary Examiner*—Kamini Shah
*Assistant Examiner*—Saif Alhija
(74) *Attorney, Agent, or Firm*—Antonelli, Terry, Stout & Kraus, LLP.

(57) ABSTRACT

The present invention relates to a method of dimensioning a riser assembly (1) intended for offshore drilling, connecting an underwater wellhead (2) to a floating support (7) comprising a main pipe (8), wherein the following stages are carried out:

selecting a complete architecture for the riser assembly from specifications, notably by fixing the thickness of the main pipe and of the buoyancy means, and calculating the apparent weight of this assembly, determining the tension margin at the top of the assembly, when disconnected from the wellhead, considering the apparent weight and the tension amplified at the top by the motion of the floating support from which the assembly is suspended, in cases where the tension margin corresponds to a value close to a determined value, calculating the Von-Mises stresses in all the sections of the pipe, when connected to the wellhead, in cases where the stresses are close to a criterion determined in connection with the yield limit of the material of the pipe, checking by calculation the load on each component of the riser assembly and its fatigue under dynamic conditions.

8 Claims, 2 Drawing Sheets

METHOD OF DIMENSIONING A DRILLING RISER

FIELD OF THE INVENTION

The present invention relates to the field of offshore drilling, notably by means of a floating support such as a dynamically-positioned ship or semisubmersible platform. In this production mode, the wellhead is located at the level of the sea bottom (mud line), which requires a pipe running through the water depth, usually referred to as riser in the trade. This riser pipe consists of elements whose length ranges between about 15 and 30 m and has to meet strict specifications considering the maritime and drilling safety conditions.

BACKGROUND OF THE INVENTION

The riser thus is a key element for offshore drilling at great water depths and it therefore has to be studied with great care. The architecture of such a riser depends on a certain number of parameters related to the operating and environmental conditions, such as the water depth, the maximum density of the drilling mud, the diameter of the peripheral lines (kill line, choke line) and their working pressure, the states of the sea and the current profiles, the offset of the (dynamically-positioned or not) floating support. The conditions are different in the drilling mode (riser connected to the wellhead and hanging from the tensioning means) and in the disconnected mode (riser suspended below the floating support, suspended from the drilling table without the agency of the tensioning means).

All these parameters have to be taken into account for dimensioning each component of the riser system: the main pipe, the peripheral lines, the connectors, the floats (buoyancy and distribution), the tensioning system . . . , while observing the standard safety rules and the drilling contractors' usual procedures.

SUMMARY OF THE INVENTION

The present invention thus relates to a method of dimensioning a riser assembly intended for offshore drilling and connecting an underwater wellhead to a floating support comprising a main pipe, wherein the following stages are carried out:

- selecting a complete architecture for the riser assembly from specifications, notably by fixing the thickness of the main pipe and of the buoyancy means, and calculating the apparent weight of this assembly,
- determining the tension margin at the top of said assembly, when disconnected from the wellhead, considering the apparent weight and the tension amplified at the top by the motion of the floating support from which said assembly is suspended,
- in cases where the tension margin corresponds to a value close to a determined value, calculating the Von-Mises stresses in all the sections of the pipe, when connected to the wellhead,
- in cases where said stresses are close to a criterion determined in connection with the yield limit of the material of the pipe, checking by calculation the load on each component of the riser assembly and its fatigue under dynamic conditions.

According to the method, the buoyancy means taken into account in stage a) can be modified when the tension margin in the disconnected mode is far from said determined value, so as to approach the value of said margin.

The buoyancy means can be modified by varying at least one of the following parameters: the number of floats, the diameter of the floats, the density of the material of the floats.

The thickness of the main pipe can be varied when the Von-Mises stresses calculated in stage c) do not meet said determined criterion. The architecture of the whole riser pipe or riser can thus be optimized.

The criterion can consist in imposing that the Von-Mises stresses are less than ⅔ of the yield limit of the steel of the main pipe.

The thickness of the pipe can be increased when said stresses are greater than about ⅔ of the yield limit, and the thickness of the pipe can be decreased when said stresses are less than about ⅔ of the yield limit.

Stages a) and b) can be carried out by taking account of a thickness loss of the main pipe and of a buoyancy loss of the buoyancy means. The thickness loss can correspond to the manufacturing tolerance and/or to corrosion. The buoyancy loss can be due to absorption of water in the course of time.

The tensioning margin in the disconnected mode can be at least equal to 20 t.

On the basis of his expertise, the applicant has thus developed a methodology for optimizing the dimensioning of drilling risers according to the conditions of use. A computing tool, for example in form of an Excel sheet, has been developed observing the methodology proposed.

BRIEF DESCRIPTION OF THE DRAWINGS

Other features and advantages of the present invention will be clear from reading the description hereafter, with reference to the accompanying drawings wherein.

DETAILED DESCRIPTION

Figure 1:
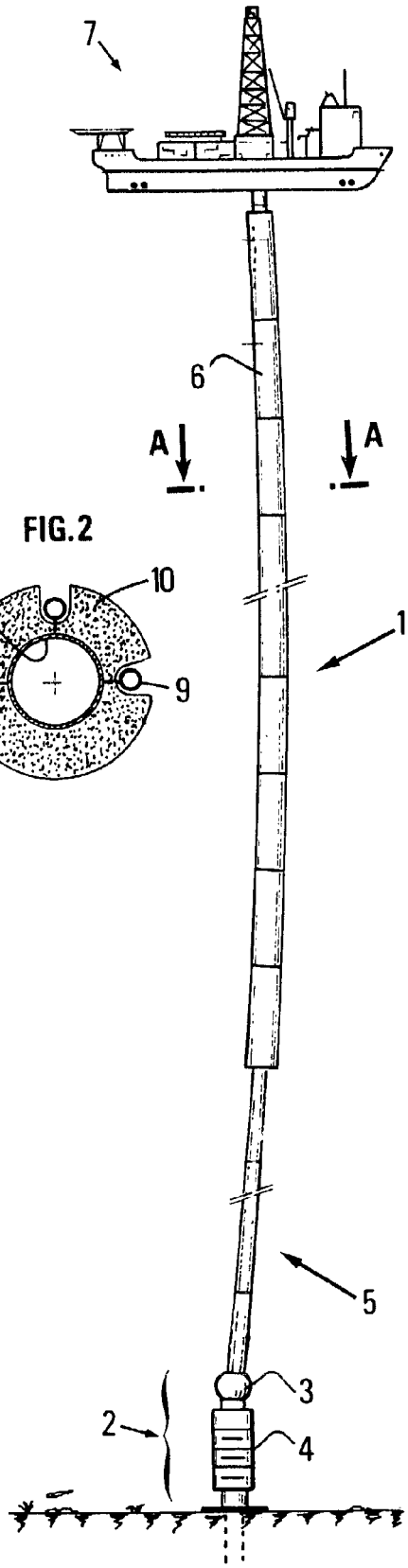
FIG. 1 describes an offshore drilling rig.

In FIG. 1, reference number 1 refers to the entire riser. The underwater wellhead is diagrammatically shown by reference number 2. The riser is connected to wellhead 2 by a flexible joint 3 fastened above upper control block 4 comprising, among other things, a connector allowing to disconnect the riser from the BOP stack. It can be noted that lower part 5 of the riser is not provided with buoyancy elements, unlike upper part 6. The top of the riser is connected to floating support 7 by means of tensioning winches (not shown).

Figure 2:
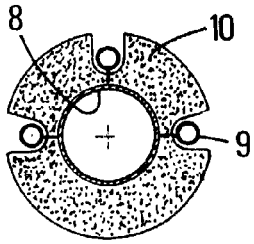
FIG. 2 shows a cross-section of a riser.

FIG. 2 is a cross-sectional view of a riser element mainly consisting of a main and central pipe 8, auxiliary tubular lines (kill line, choke line, boosting line) 9, buoyancy elements 10, generally in form of two half shells made of syntactic foam or of an equivalent material.

Figure 3:
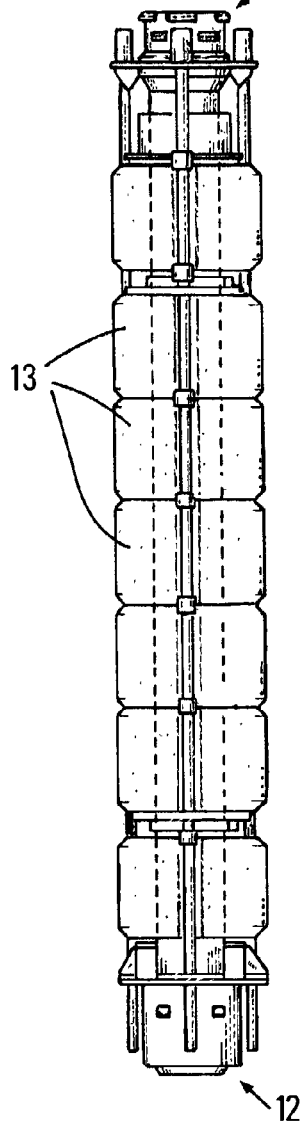
FIG. 3 shows a riser element equipped with buoyancy means.

FIG. 3 illustrates a riser element comprising a pair of connectors, an upper connector 11 and a lower connector 12, whose purpose is to connect the main pipes with one another, and also to connect the auxiliary lines. Reference number 13 refers to a buoyancy element half shell.

Riser Mechanics

The tension $T_{Top}$ at the top of the riser is an important parameter which has to be known with precision in order to select the suitable tensioning system. This tension consists of three terms:

$$T_{Top}=W^{riser}+W^{mud}+T_{bottom} \quad \text{(E1)}$$

where:
$W^{riser}$: apparent weight of the riser (in sea water)
$W^{mud}$: apparent weight of the mud
$T_{bottom}$: residual tension at the bottom of the riser.

These terms are calculated separately, considering the characteristics of the riser. For example:

$$\blacklozenge W^{riser}=W^{MP}+W^{AL}+W^{misc}+\Delta^{BM} \quad \text{(E2)}$$

where:
$W^{MP}$: apparent weight of the main pipe (21" central pipe and connectors)
$W^{AL}$: apparent weight of the peripheral lines
$W^{misc}$: apparent weight of the other components (telescopic joint, flexible joint, terminal joint, etc.)
$\Delta^{BM}$: apparent weight of the floats (of negative sign)

$$\blacklozenge W^{mud} = \frac{\pi}{4}\left[ID_{MP}^2 + \sum ID_{AL}^2\right] * (\rho_{mud} - \rho_{sw}) * L^{riser} \quad \text{(E3)}$$

where:
$ID^2_{MP}$: inside diameter of the main pipe
$ID^2_{AP}$: inside diameter of the peripheral lines
$\rho_{SW}$: density of the sea water
$L^{riser}$: total length of the riser.

♦ The residual tension $T_{bottom}$ at the bottom of the riser has to be maintained positive so as to keep an angle at the bottom within the limits set by the 16Q API standard (mean angle of 2° under static conditions). In most cases, this tension is of the order of 100 t.

Effective Tension and True Tension

There is a fundamental difference between the effective tension and the true tension. Generally, the true tension $T_{true}$ governs the strains and the stresses in the pipe and the connectors. $T_{effective}$ is the tension which governs the stability of the connection, and the elastic line and the flexion in the riser. The relation between these two tensions is as follows:

$$T_{true}=T_{effective}+P_iS_i-P_eS_e \quad \text{(E4)}$$

where:
$P_i$, $P_e$: internal and external pressure of the pipe respectively
$S_i$, $S_e$: internal and external section respectively.

The effective tension can be calculated at any point of the riser:

$$T_{effective}^{riser}(z) = T_{Top} - \sum_{z}^{top} (W^{riser} + W^{mud}) \quad \text{(E5)}$$

The equation giving the elastic line (y) of the riser can be derived as follows $$EI\frac{\partial^4 y}{\partial z^4} - \frac{\partial}{\partial z}\left(T_{eff}\frac{\partial y}{\partial z}\right) = q(z) \quad \text{(E6)}$$

where:
E: Young's modulus of the material
I: moment of inertia of the riser
q(z): lateral load due to the current.

The effective tension must always be positive at any point of the riser to prevent instability phenomena, buckling for example.

$$T_{effective}^{riser} = T_{effective}^{MP} + \sum T_{effective}^{AL} \quad \text{(E7)}$$

This equation allows to couple the tensions in the various pipes (main pipe and auxiliary lines) and thus to recalculate all the thrust loads in each component of the riser.

Behaviour of the Peripheral Lines Under Pressure:

These small-diameter pipes are fastened individually along each riser element. Their ends are provided with the required seals, but they include no device allowing stresses to be transmitted from one pipe to the next: the simply floating pipes fit into one another. Thus, by first approximation, no high actual tension is exerted on these pipes $$(T_{actual}^{AL} \approx -P_i(S_e - S_i))$$

if we assume that the seal diameter equals the outside diameter of the pipe. These pipes carry fluids under high working pressure and therefore $$T_{effective}^{AL} = -(P_i - P_e)S_{seal}^{AL}$$

is greatly negative if the pipe is under high internal pressure. Thus, the pipes will tend to buckle and properly spaced-out clamps are required to overcome this tendency.

Influence of the Pressure in the Peripheral Lines on the Main Pipe:

Another important effect induced by the pressure applied to the peripheral lines is the increase in the traction in the main pipe. In fact, the total effective tension of the riser $$(T_{effective}^{riser})$$

is unchanged when the lines are under pressure (see Equation (E5)) because the weight of the mud and of the riser remain constant. The effective tension of the peripheral lines $$(T_{effective}^{AL})$$

decreases (negative value) as a result of the pressurization. The effective tension of the main pipe increases (E7). Thus, considering Equation (E5), the true tension in the main pipe increases similarly:

$$\delta\langle T_{true}^{MP}\rangle + \sum \delta(T_{effective}^{AL}) = 0 \quad \text{(E8)}$$

An additional traction is therefore exerted in practice on the main pipe when the peripheral lines are under pressure, of the order of 250 t per peripheral line under a 15,000-psi working pressure (103.5 MPa) and 4½" (114.3 mm) in inside diameter.

Stresses in the Connectors:

Because of the composition of the riser, all the stresses transit through the connectors. These stresses are higher than those in the main pipe and can be calculated as follows:

$$T_{true}^{connector} = T_{effective}^{MP} + (P_i - P_e) * S_{seal} \quad \text{(E9)}$$

where $S_{seal}$, is the seal section of the connector.

$$T_{effective}^{MP}$$

normally has a maximum value at the top of the riser. $(P_i - P_e) * S_{seal}$ has a maximum value at the bottom of the riser. Thus, there is a depth for which tension $$T_{true}^{connector}$$

in the connectors reaches a maximum value (about 1500-2000 m) according to the density of the mud considered.

Design Principles for Drilling Risers

The drilling riser has to be dimensioned according to the recommendations of the API 16Q standard:

the Von-Mises stresses are less than ⅔ of the yield limit, the mean angle at the bottom of the riser is less than 2° under static conditions.

No other quantitative specification is given in this recommendation. In order to take account of the corrosion, the fatigue, the pressure in the peripheral lines, etc., for dimensioning drilling risers, the invention proposes a convenient methodology for drilling risers, both in the drilling mode and in the disconnected (stand-by) mode.

♦ Drilling Mode

It is the commonest mode. The criteria selected for the drilling mode are given hereafter.

The Von-Mises stresses have to be less than ⅔ of the yield limit, considering the following parameters:

the riser is connected to the drill rig by a telescopic joint and a tensioning system;

the riser is filled with the mud of maximum density;

the peripheral lines are under pressure;

the thickness of the main pipe is decreased by 5%, over the total length thereof, to take account of the tolerances of the pipes;

the thickness of the main pipe is decreased by 2 mm to take account of the corrosion;

the floats have a 3% buoyancy loss due to the penetration of sea water.

♦ Disconnected Mode: Stand-By

In this critical situation, in order to prevent the ruin of the structure, the tension at the top of the riser must always remain positive when the drilling support is subjected to heave. The tension at the top of the riser is the difference between the apparent weight of the riser and the tension amplified by the heave undergone by the floating support. This criterion therefore requires that the weight of the suspended riser is greater than the maximum amplitude of the tension variation at any point of the riser. A 20-t safety margin can be taken for example. The amplified tension of the riser, according to the heave, results from a conventional dynamic calculation.

Thus, in this mode, calculations have to take account of the following assumptions:

the riser is disconnected from the wellhead;

the main pipe and the peripheral lines are filled with water;

the peripheral lines are at the hydrostatic pressure;

the thickness of the main pipe is decreased by 5%, over the total length thereof, to take account of the tolerances of the pipes;

the thickness of the main pipe is decreased by 2 mm to take account of the corrosion;

the floats have a 3% buoyancy loss due to the presence of sea water.

During the dimensioning stage, the calculations are carried out iteratively between these two modes in order to optimize the architecture. The thickness of each riser section is optimized so as to meet the criteria of the (connected) drilling mode whereas the compensation (see formula below) is adjusted to prevent <<detensioning>> (tension at the top negative or below a safety margin) in the disconnected mode.

Compensation (C) is defined as follows:

$$C\% = \frac{\Delta^{BM}}{\sum (W^{MP} + W^{AL} + W^{misc})} \quad \text{(E10)}$$

The compensation is an important ratio allowing to fix the diameter of the floats. In a first design stage, the compensation must be as high as possible for the tension at the top to have a miminum value. However, the compensation must be adjusted to meet the criteria of the disconnected mode. A compromise has to be found to meet the criteria.

N.B.: a 100% compensation means that the apparent weight of the riser is zero.

As we have seen in the paragraph above, dimensioning of the riser depends on many parameters:

the environmental conditions and the water depth are set by the location of the borehole;

the maximum density of the mud is imposed by the predictions of the expected pressures, notably the reservoir pressure;

the characteristics of the peripheral lines (diameter, working pressure) are determined from the working pressure of the BOPs (10,000 psi or 15,000 psi);

the diameter of the main pipe of the riser (often 21") is imposed by the drilling program;

the characteristics of the material of the floats define the various sections of the riser: one section for one foam density (often every 500 to 600 m).

With these more or less imposed elements, a preliminary dimensioning (thickness and diameter of the floats) can be found. To optimize this dimensioning, iterations on the global compensation and the thickness of the main pipe of each section can be carried out as described below.

First, the disconnected mode criterion has to be checked (see the aforementioned dimensioning principles). The safety as regards <<detensioning>> has to be determined considering decennial or centennial sea conditions. If the safety margin is negative (i.e. the riser is subjected to a dynamic buckling risk), the compensation has to be decreased. If the safety margin is too great, the compensation can be increased.

Once the compensation is adjusted in the disconnected mode, the connected mode criteria (see the aforementioned dimensioning principles) have to be checked. The Von-Mises criteria have to be checked for each riser section. If these stresses exceed ⅔ of the yield limit, the thickness of the main pipe has to be increased by 1/16 of an inch. Conversely, if these stresses are below the yield limit, the thickness of the main pipe can be decreased by 1/16". After each modification of the thickness of a section, the safety margin as regards <<detensioning>> has to be checked in order to adjust the compensation again.

All these iterations must lead to the final design of the riser system. The maximum tension at the top can thus be deduced considering a nominal thickness of the main pipe, without corrosion, and with a 3% buoyancy loss of the floats. This tension at the top has to be compatible with the capacity of the tensioners calculated according to API 16Q (section 3.3.2). Furthermore, the class of the connectors must also be in accordance with the maximum strains calculated with the pressure in the peripheral lines (see Equation E9).

Finally, the last design stage involves a dynamic calculation. These calculations must take account of the displacements of the rig (heave, offset), the current profile, the sea conditions so as to evaluate the axial and flexural stresses at any point of the riser, as well as the angle at the bottom. This last stage can be carried out by means of a finite-element software such as, for example, DeepLines™ (IFP) (Fully coupled dynamic analysis of rigid lines—J. M. Heurtier, F. Biolley (IFP); C. Berhault (Principia)—pp.246-252, Proceedings of ISOPE 98—Canada—Montreal).

Figure 4:
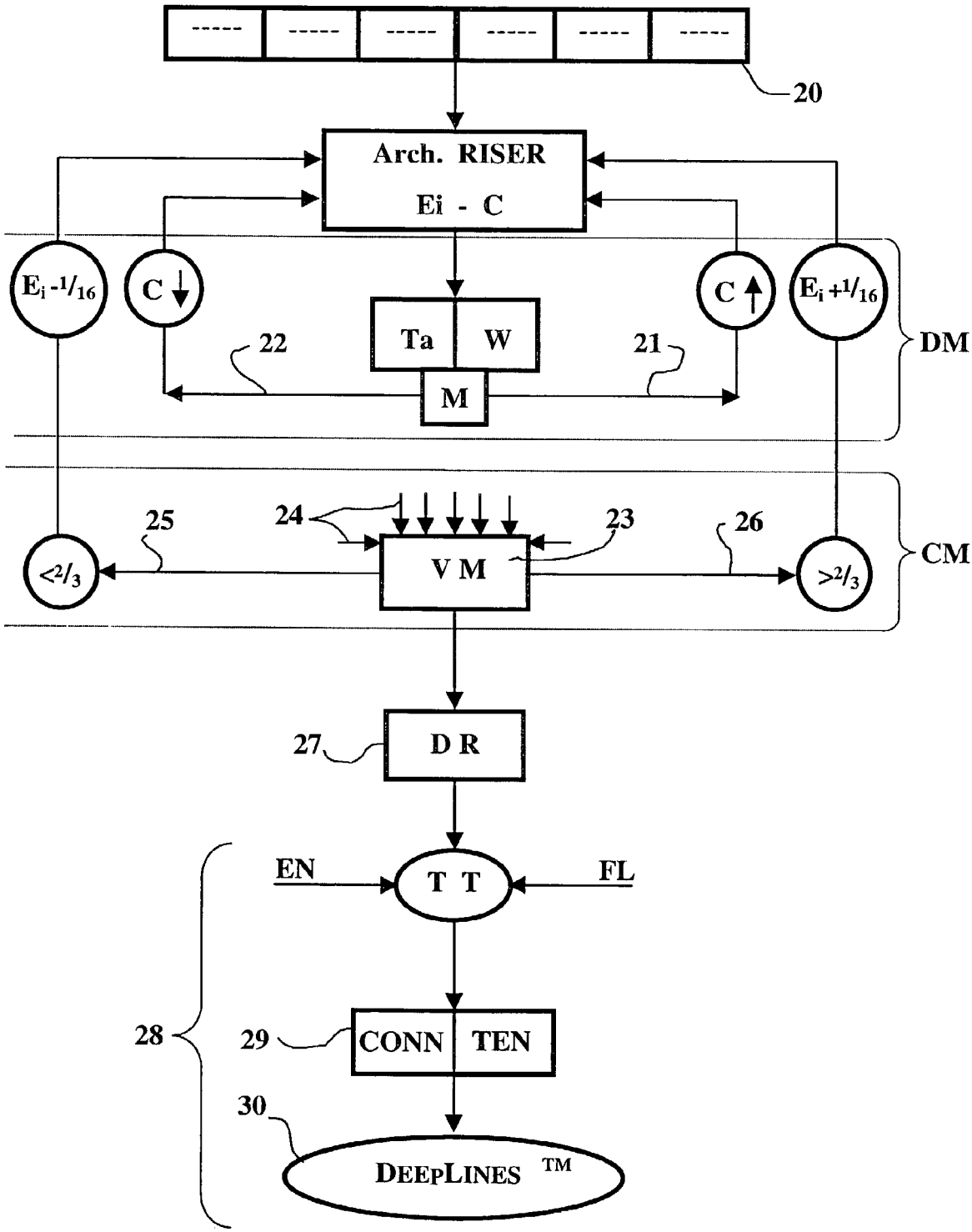
FIG. 4 illustrates the principle of the methodology according to the invention.

This methodology can be schematized by means of the flowchart of FIG. 4.

The assembly consisting of blocks 20 diagrammatically represents the inputs of calculation data:

- characteristics of the main pipe, the connectors, the auxiliary elements (telescopic joint, flexible joint, control baseplate, . . . );
- characteristics of the peripheral auxiliary lines;
- characteristics of the floats;
- sea conditions, currents, depth, wind, waves, . . . ;
- data related to the drilling program: density of the drilling fluid, diameter of the internal pipe.

An inner pipe diameter, its thickness Ei and a buoyancy determined by compensation parameter C are selected a priori from these non exhaustive data. This first architecture allows to calculate, in the disconnected mode DM, the safety margin M which represents the tension margin between the amplified tension Ta of the riser as a result of the heave undergone by the support and the apparent weight of the riser W. If this margin is negative, or considered to be insufficient, the calculation is completed with line 21 by decreasing the value of compensation C. If the margin is considered to be too great, the calculation is completed with line 22 by increasing compensation C. A margin of about 20 tons can be taken for example.

After these stages in the disconnected mode DM, the Von-Mises stresses VM are calculated in the connected mode CM shown by block 23, by means of the riser architecture determined above.

The various arrows 24 represent the data taken into account for this calculation of the Von-Mises stresses, for example:

- steel grades of the pipes;
- tension at the bottom of the riser (100 t for example);
- thickness tolerance of the main pipe;
- consideration of a thickness decrease (about 1/16" (1 inch=25.4 mm)) as a result of corrosion;
- maximum density of the mud;
- buoyancy loss of about 3%;
- pressurization of the auxiliary lines.

In cases where, in all the sections of the riser, the Von-Mises stresses are less than ⅔ of the yield limit of the steel of the main pipe, the calculation is completed with line 25 by decreasing the thickness of the pipe of the architecture considered previously, for example by about 1/16" (1.5875 mm) to optimize the riser. In cases where the stresses are greater than ⅔ of the yield limit of the steel of the main pipe, the calculation is completed with line 26 by increasing the thickness of the pipe of the architecture considered previously.

These successive iterations lead to an optimization of the whole riser, including the buoyancy elements.

Block 27 diagrammatically shows the final architecture obtained, which meets the specifications and the standards in force.

Stages 28 can be likened to checks by calculating the tension TT at the top of the riser by taking account of the nominal thickness EN of the pipe, without corrosion, and by considering a 3% buoyancy loss. From TT, we check (block 29) that the connectors are compatible with this tension, and that the tensioning means of the floating support are sufficient.

During the last checking stage, the architecture of the riser obtained is checked under dynamic conditions by means of the DeepLines™ software (IFP) or of an equivalent software.

The invention claimed is:

1. A method of dimensioning a riser assembly intended for offshore drilling, connecting an underwater wellhead to a floating support comprising a main pipe, wherein the following stages are carried out:

a) selecting a complete architecture for the riser assembly from specifications, including by fixing the thickness of the main pipe and of buoyancy elements, and calculating the apparent weight of this assembly, b) determining the tension margin at the top of said assembly, when disconnected from the wellhead, considering the apparent weight and the tension amplified at the top by the motion of the floating support from which said assembly is suspended, c) in cases where said tension margin corresponds to an acceptable determined value, calculating the Von-Mises stresses in all the sections of the pipe, when connected to the wellhead and, in cases where said tension margin does not correspond to an acceptable determined value, modifying an aspect of the architecture for the riser assembly to approach an acceptable determined value and redetermining said tension margin, and, d) in cases where said stresses correspond to an acceptable criterion determined in connection with the yield limit of the material of the pipe, obtaining the architecture of the riser assembly and checking the compatibility of each component of the riser assembly at the maximum tension value, and the fatigue under dynamic conditions of said assembly, and, in cases where said stresses do not correspond to an acceptable criterion, modifying an aspect of the architecture for the riser assembly to approach an acceptable determined criterion and redetermining said stresses.

2. A method as claimed in claim 1, wherein the buoyancy elements taken into account in stage a) are modified when said tension margin in the disconnected mode do not correspond to said acceptable determined value, so as to approach the value of said margin.

3. A method as claimed in claim 2, wherein the buoyancy elements comprise a plurality of floats and are modified by varying at least one of the following parameters: the number of floats, the distribution of the floats, the diameter of the floats, the density of the material of the floats.

4. A method as claimed in claim 1, wherein the thickness of the main pipe is varied when the Von-Mises stresses calculated in stage c) do not meet an acceptable determined criterion.

5. A method as claimed in claim 4, wherein said acceptable determined criterion requires that the Von-Mises stresses are less than ⅔ of the yield limit of the steel of the main pipe.

6. A method as claimed in claim 5, wherein the thickness of the pipe is increased when said stresses are greater than about ⅔ of the yield limit, and the thickness of the pipe is decreased when said stresses are less than about ⅔ of the yield limit.

7. Method as claimed in claim 1, wherein stages a) and b) are carried out by taking account of a thickness loss of the main pipe and a buoyancy loss of the buoyancy elements.

8. Method as claimed in claim 1, wherein said tension margin is at least 20 t.

* * * * *